US005908207A

United States Patent [19]

Wilson

[11] Patent Number: 5,908,207

[45] Date of Patent: Jun. 1, 1999

[54] BOOK HOLDER

[75] Inventor: Douglas E. Wilson, 34 Overlook Dr., Atkinson, N.H. 03811

[73] Assignee: Douglas E. Wilson, Atkinson, N.H.

[21] Appl. No.: 08/859,302

[22] Filed: Apr. 14, 1997

[51] Int. Cl.[6] ..... B42D 3/00

[52] U.S. Cl. ..... 281/45; 281/43; 248/451

[58] Field of Search ..... 281/42, 45, 51, 281/43, 15.1, 28; 402/4; 248/446, 447, 454, 451, 441.1

[56] References Cited

U.S. PATENT DOCUMENTS 5,356,109 10/1994 Biasini ..... 281/45

5,761,753 6/1998 Talbent ..... 281/45

*Primary Examiner*—Willmon Fridie, Jr.

[57] ABSTRACT

The book holder is mounted on a stand. The book is held on the book holder by four clamps. Upper wooden post (24) is mounted on lower wooden post (25) and is free to rotate. As shown the wooden feet (26) and (27) are fastened to lower post (25) by means of the round steel nut (28), threaded stud (30), and wingnut (29). The stand can be quickly and easily assembled and dissassembled by one screw and wingnut holding it together. The wooden wingnut wrench shown is used to turn wingnut (29) and all other wingnuts on the book holder.

2 Claims, 2 Drawing Sheets

Fig. 1
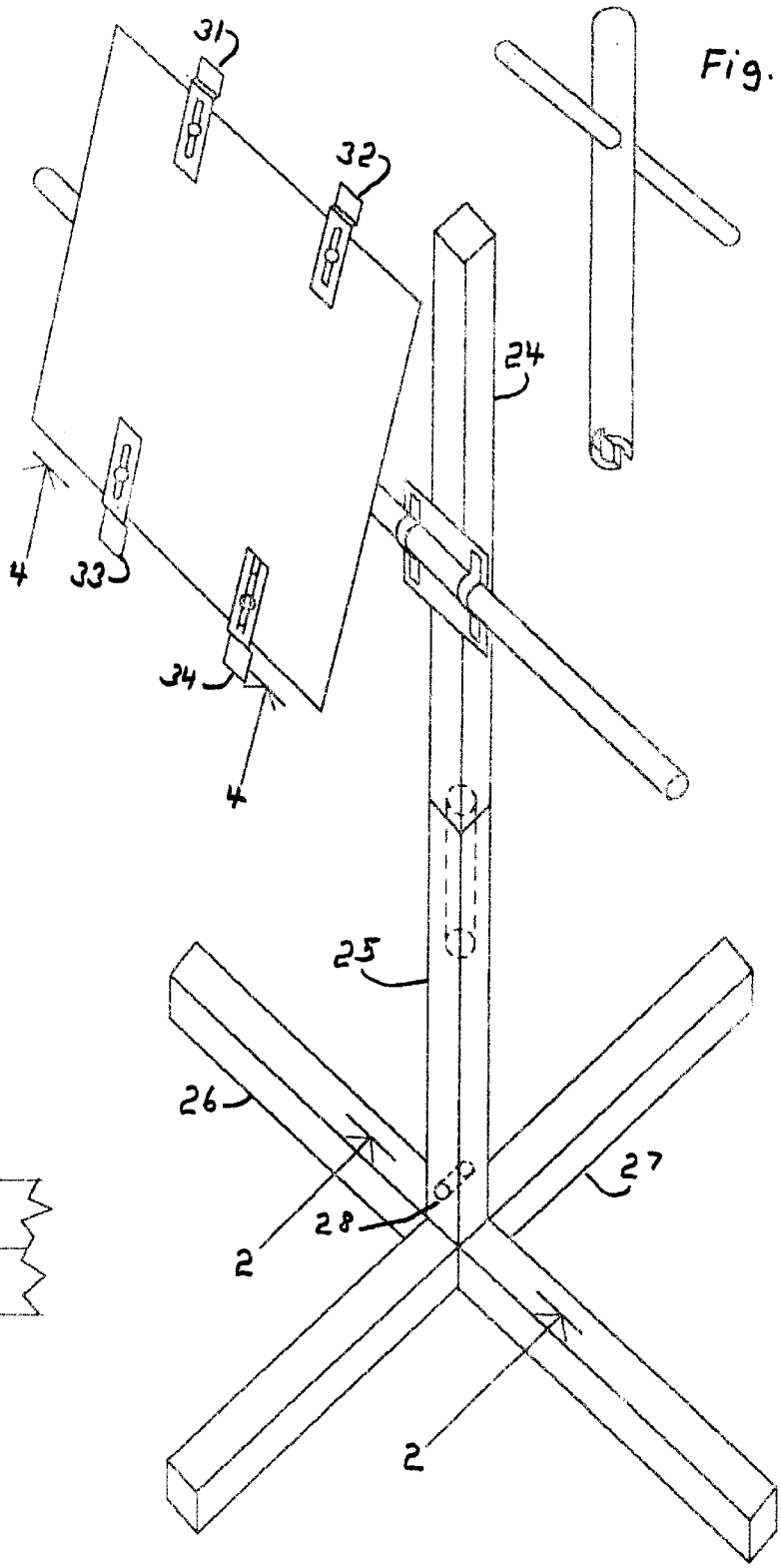
Fig. 3
Fig 2
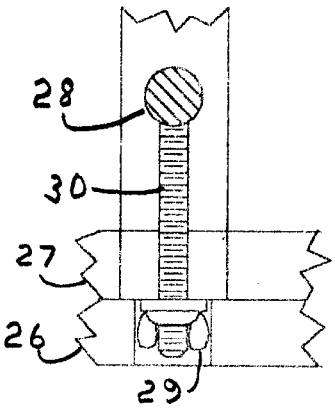

BOOK HOLDER

My invention relates to a book holder which is mounted on a stand. The book holder stand is adjustable for height, angle, and rotation.

It is amoung the objects of the present invention to provide a simple inexpensive book holder which can be used by handicapped or others to relieve the arms and hands from holding the book and also allow the body to sit or recline in a comfortable position.

It is another object of the invention, to be able to read the pages of the book without any hindrance to the vision such as a plastic or other transparent material covering the pages.

It is another object for the book holder to be adjustable to allow different sizes of books to be accommadated.

It is another object to be able to quickly and easily change from one book to a new book of a different size.

It is a further object to provide a light for locations having low illumination or at night when there is no electricity available.

It is a still further object to have the book holder and stand, transportable, easily and quickly assembled or disassembled. Still furthur objects will become apparent in the following detailed description, it being understood that the description is all for illustration and explanation and not by way of limitation, since various improvements may be made by those skilled in the art without departing from the spirit of the present invention. With these objects in view, as well as other objects which will appear in the course of the specification, reference will be made to the drawing, wherein:

FIG. 1 is an isometric view of the book holder stand.

FIG. 2 is an enlarged sectional view of the holding device shown on section 2—2 of FIG. 1.

FIG. 3 is an isometric drawing of a wooden wrench, used to loosen or tighten the wingnuts in fastening the components together.

Figures 4, 5, 6:
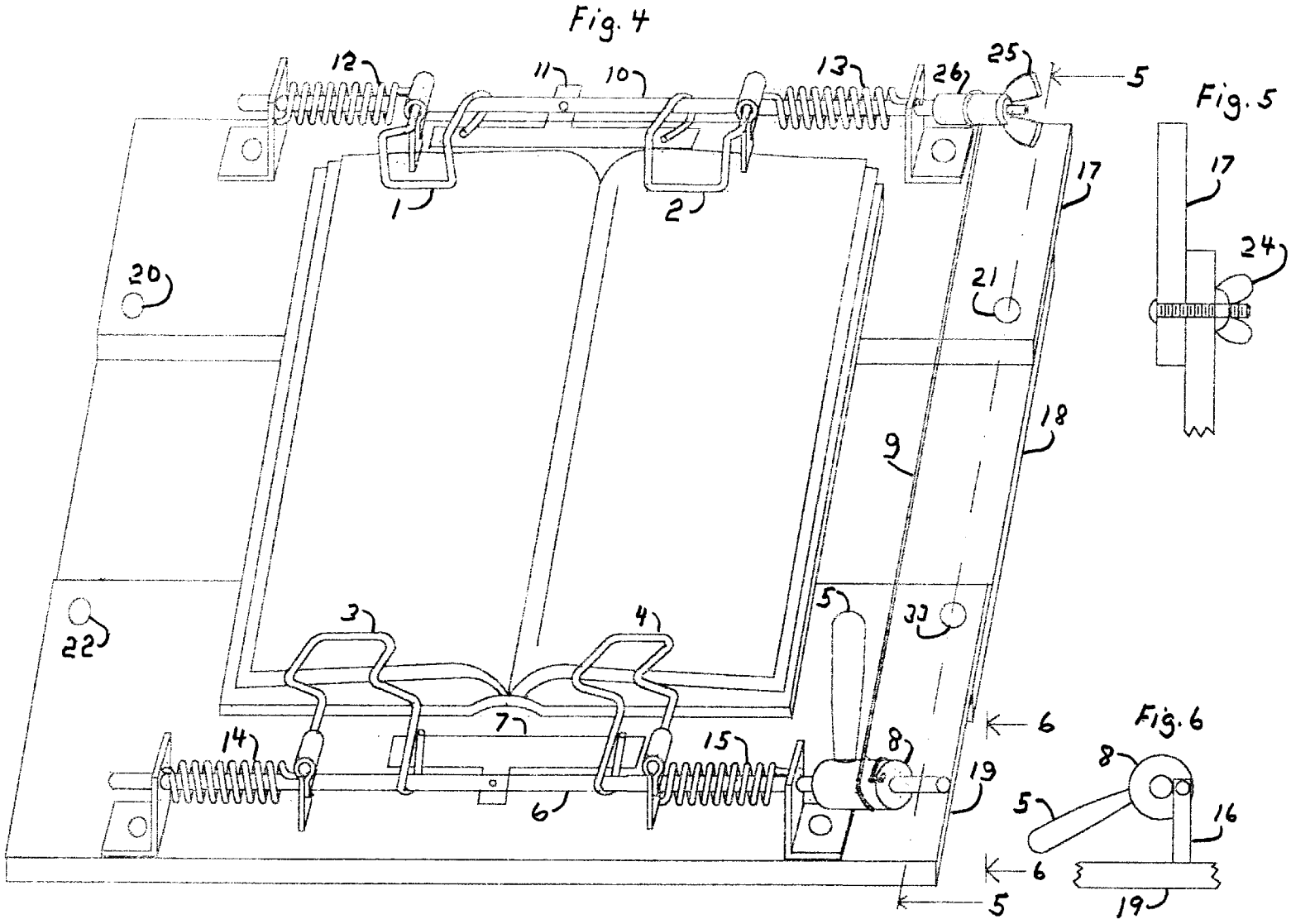
FIG. 4 is an isometric view of a book holder base, taken from view 4—4 of FIG. 1 embodying the present invention.
FIG. 5 is a sectional view taken on the line 5—5 of FIG. 4 showing how the base plates are fastened together.

FIG. 6 is a view 6—6 of FIG. 4 showing dog 16 in a position to hold clamps 1 thru 4 retracted from the book.

The book holder is mounted on a stand as shown in FIG. 1. The book is held on the book holder by four clamps 31 thru 34. Upper wooden post 24 is mounted on lower wooden post 25 and is free to rotate. As shown on FIG. 2, the wooden feet 26 and 27 are fastened to lower post 25 by means of the round steel nut 28, threaded stud 30, and wingnut 29. The stand can be quickly and easily assembled and dissassembled by one screw and wingnut holding it together. The wooden wingnut wrench shown in FIG. 3 is used to turn wingnut 29 and all other wingnuts on the book holder.

Referring to FIG. 4, the pages are held in place by four clamps 1 thru 4. The clamps can be retracted from the book by the right hand lifting the handle 5 on driver pulley 8, which turns shaft 6 counter clockwise. Paddle 7, fastened to shaft 6, lifts clamps 3 and 4 from the lower part of the book pages.

Driver pulley 8 winds up cable 9 which causes shaft 10 to turn clockwise. Paddle 11 raises clamps 1 and 2 from the upper part of the book pages. The left hand can now turn to the next page of the book, and the handle 5 can be released to allow the springs 12 thru 15 to force the clamps 1 thru 4 to hold down the book pages. The four clamps work independently of each other by the action of the four springs 12 to 15 so that they will clamp on the pages when the left side is a different height from from the right side.

To facilate the loading or unloading of different books from the book holder, the clamps may be lifted from the books by means of handle 5 and positioning dog 16 to hold the clamps 1 thru 4 retracted from the book pages as shown on FIG. 6.

The book holder is made up of base plate 18, upper plate 17, and lower plate 19, which are fastened to the base plate 18 with four carriage bolts 20 thru 23 with wingnuts as shown by item 24 on FIG. 5. There is an additional set of matching holes in the base plate allowing a ½ inch adjustment. The upper and lower plates can thus be moved so as to accommodate different sizes of books and allow the clamps 1 thru 4 to rest on the borders of the pages so as not to interfere with reading. The cable 9 can be adjusted to maintain the proper tension by loosening thumb nut 25, turning pulley 26, and retightening 25.

The book holder is shown configured for a right handed person. For a left handed person, the handle 5 would be mounted on the left end of shaft 6. The two shafts mounted on the top and bottom of the book holder could also be mounted on either side of the book holder, 90 degrees from the position as shown on FIG. 4. This would allow the clamps to function on the sides of the page and reducing the number of clamps from four to two, likewise reducing the number of of springs from four to two. A battery operated light can be attached to the book holder so that any other lights in the room would not be necessary.

The book holder base items 17,18, and 19 are made from tempered Masonite, but could be made of wood, plastic, metal or any suitable composition type of material.

The four springs 12 thru 15 and four clamps 1 thru 4 can be made as one piece combining their funcions.

Having now particularly described and ascertained the nature of the invention, and in what manner the same is performed,

What is claimed is:

1. A device for enabling a person to read a book without holding it, while either in a sitting or a reclining position, said device comprised of:

(a) a wooden supporting stand comprising:
  i. a vertical post mounted on another vertical post in such a manner that the upper vertical post can freely turn on its axis;
  ii. the lower vertical post mounted on two legs;

(b) a wooden horizontal rod clamped to the upper post with adjustments for height and angular rotation of the shaft;

(c) a central back mounting book support panel, mounted on the horizontal rod comprising:
  i. two mounting holes for an upper extension back support panel using two carriage bolts, and two wingnuts on the rear of the support panel;
  ii. two mounting holes for a lower extension back support panel using two carriage bolts, and two wingnuts on the rear of the support panel;

(d) an upper extension back support panel with three sets of matching holes to the central back support panel allowing the extension back support panel to be spaced in increments of one inch above the central support panel, and comprising:
  i. two book cover clamps for the upper edge of the book;
  ii. a horizontally mounted rotatable shaft comprising two spring loaded page clamps, a spring release paddle, a follower pulley with a drive cord connected to the driver pulley;

(e) a lower extension back support panel with two sets of matching holes to the central back support panel allowing the extension back support panel to be spaced in increments of one inch below the central back panel, and comprising:

i. two book cover clamps for the lower edge of the book;

ii. a horizontally mounted rotatable rod comprising two spring loaded page clamps, a spring release paddle and a driver pulley with a finger actuated lever, and a detent dog which can hold the springs raised above the pages for easy removal of the book;

(f) raising the driver pulley lever causes the driver pulley to turn counter-clockwise, the paddle raising the lower springs from the pages, likewise the upper follower shaft turns clockwise due to the movement of the drive chord, and the paddle lifts the upper two spring clamps above the pages allowing them to be freely turned.

2. A device for enabling a person to read a book without holding it, while either in a sitting or a reclining position, said device comprised of:

(a) a wooden supporting stand comprising:

i. a vertical post mounted on another vertical post in such a manner that the upper vertical post can freely turn on its axis;

ii. the lower vertical post mounted on two legs;

(b) a wooden horizontal rod clamped to the upper post with adjustments for height and angular rotation of the shaft;

(c) a central book mounting back support panel, mounted on the horizontal rod comprising:

i. two mounting holes for a left extension back support panel using two carriage bolts, and two wingnuts on the rear of the support panel;

ii. two mounting holes for a right extension back support panel using two carriage bolts, and two wingnuts on the rear of the support panel;

(d) an extension left back support panel with three sets of matching holes to the central back support panel allowing the left extension back support panel to be spaced in increments of one inch to the left of the central support panel, and comprising:

i. one book cover clamp for the left edge of the book;

ii. a vertically mounted rotatable shaft comprising a page spring loaded clamp, a spring release paddle, a follower pulley with a cord conneced to the driver pulley;

(e) a right extension back support panel with two sets of matching holes to the central back support panel allowing the extension back support panel to be spaced in increments of one inch to the right of the central support panel, and comprising:

i. a book cover clamp for the right edge of the book;

ii. a vertically mounted rotatable shaft comprising a spring loaded page clamp, a spring release paddle and a driver pulley with a drive cord connected to the follower pulley, the driver pulley having a detent dog mounted in such a way that when activated by the wooden lever can keep the spring clamps above the pages for easy removal of the book;

(f) raising the driver pulley lever turns the driver pulley clockwise, the paddle raising the right hand springs from the pages, likewise the follower shaft turns counter-clockwise due to the movement of the drive chord, and the paddle lifts the left side spring clamp above the pages allowing them to be freely turned.

* * * * *